US005675108A

United States Patent [19]

Balbo et al.

[11] Patent Number: 5,675,108

[45] Date of Patent: Oct. 7, 1997

[54] DEVICE FOR MANUALLY OPENING A WEDGE BREECHBLOCK AND GUN EQUIPPED WITH SUCH A DEVICE

[75] Inventors: Patrick Balbo, Bourges; Guy Malassenet, Pigny; Fabienne Mandereau; Philippe Grelat, both of Bourges, all of France

[73] Assignee: Giat Industries, Versailles, France

[21] Appl. No.: 492,132

[22] Filed: Jun. 19, 1995

[30] Foreign Application Priority Data

Jun. 17, 1994 [FR] France ..... 94 07475

[51] Int. Cl.[6] ..... F41A 3/00

[52] U.S. Cl. ..... 89/22; 89/24; 89/25

[58] Field of Search ..... 89/22, 24, 25

[56] References Cited

U.S. PATENT DOCUMENTS

| | | | |
|---|---|---|---|
| 1,076,875 | 10/1913 | Driggs | 89/24 |
| 1,422,037 | 7/1922 | Dawson | 89/24 |
| 2,216,860 | 10/1940 | Summerbell | 89/24 |
| 2,434,970 | 1/1948 | Summerbell | 89/24 |
| 2,522,497 | 9/1950 | Beardsley et al. | 89/24 |
| 2,580,483 | 1/1952 | Summerbell | 89/24 |

FOREIGN PATENT DOCUMENTS

| | | |
|---|---|---|
| 325836 | 10/1902 | France . |
| 381466 | 1/1908 | France . |
| 28 26 739 | 12/1979 | Germany . |
| 0 349706 | 1/1990 | Germany . |
| 212958 | 3/1924 | United Kingdom . |

*Primary Examiner*—J. Woodrow Eldred
*Attorney, Agent, or Firm*—Oliff & Berridge

[57] ABSTRACT

A manual breechblock opening device that actuates a breechblock lever to open a wedge breechblock of a gun against an elastic return force includes a manual control member, a drivetrain and a holder. The manual control member is disposed within reach of an operator. The drivetrain includes a rotating output shaft coupled to the breechblock lever and a rotating input shaft coupled to the output shaft and coupleable to the manual control member. Actuating the manual control member rotates the drivetrain in a first rotational direction and causes the output shaft to engage the breechblock lever and to open the wedge breechblock. The blocking member is coupled to and disposed to prevent the rotation of the drivetrain in a second rotational direction that is opposite the first rotational direction.

19 Claims, 3 Drawing Sheets

DEVICE FOR MANUALLY OPENING A WEDGE BREECHBLOCK AND GUN EQUIPPED WITH SUCH A DEVICE

BACKGROUND OF THE INVENTION

1. Field of the Invention

The present invention relates to artillery and, in particular, to a device for manually opening the wedge breechblock of tank or field artillery and artillery equipped with such a device.

2. Description of Related Art

All artillery with a wedge breechblock is generally equipped with an emergency wedge breechblock opening system. This system is used when a munition fails to function, i.e., when the wedge breechblock does not open automatically.

European Patent 0,349,706 discloses a device having a lever that forms a handle for opening or closing a sliding breechblock. Another known device is the Leclerc 120 tank gun, which includes a wedge breechblock opening system having a hydraulic screw that is actuated by a manual pump.

These known systems, however, use hydraulic or pneumatic control and require relatively large scale configurations that are incompatible with the limited space available in some guns. For example, these hydraulic or pneumatic systems include at least a reservoir, a pump, a motor, a screw and piping that must be disposed in or around the gun. These systems are also subject to leakage and explosions, which increase the risk of injury to the gun crew.

On the other hand, purely mechanical opening systems that do not use pneumatic or hydraulic energy are disfavored because of the substantial force such a system must withstand. This force is developed by the breechclosing spring used on, e.g., tank artillery. Some mechanical systems are used in smaller caliber weapons (90 mm and 105 mm) in which the force is of a lower magnitude, but these systems do not include a safety device to protect the user if the munition explodes unexpectedly.

SUMMARY OF THE INVENTION

Objects of the present invention include limiting the size of the device and eliminating the need to input additional energy into the gun.

To achieve these and other objects, the present invention provides a manual breechblock opening device that actuates a breechblock lever to open a wedge breechblock of a gun against an elastic return force. The breechblock opening device includes a manual control member, a drivetrain and a blocking device.

The drivetrain includes a rotating output shaft coupled to the breechblock lever and a rotating input shaft coupled to the output shaft and coupleable to the manual control member. By actuating the manual control member, the drivetrain can be rotated in a first rotational direction to cause the output shaft to engage the breechblock lever and to open the wedge breechblock. The blocking member is coupled to the drivetrain and disposed to prevent the drivetrain from rotating in a second rotational direction. The second rotational direction is opposite to the rotational direction.

The manual control member can be removably coupled to the input shaft. The manual control member can include a ratchet and the blocking member can include a pawl disposed to cooperate with the ratchet. The manual control device can include an engaging portion shaped to engage the input shaft and a handle extending substantially perpendicular to the engaging portion.

The blocking member can be disposed to engage the manual control member. The blocking member can also be connectable to the gun. The input shaft can be disposed substantially perpendicular to the output shaft. The drivetrain can reduce a manual control member force required to actuate the breechblock lever by a factor of approximately 60.

The manual breechblock opening device can include a holder attached to the gun that is disposed to hold the manual control member during recoil of the gun.

BRIEF DESCRIPTION OF THE DRAWINGS

A complete understanding of the present invention may be obtained by reference to the accompanying drawings, when considered in conjunction with the subsequent detailed description thereof, in which.

DETAILED DESCRIPTION OF PREFERRED EMBODIMENTS

Figure 1:
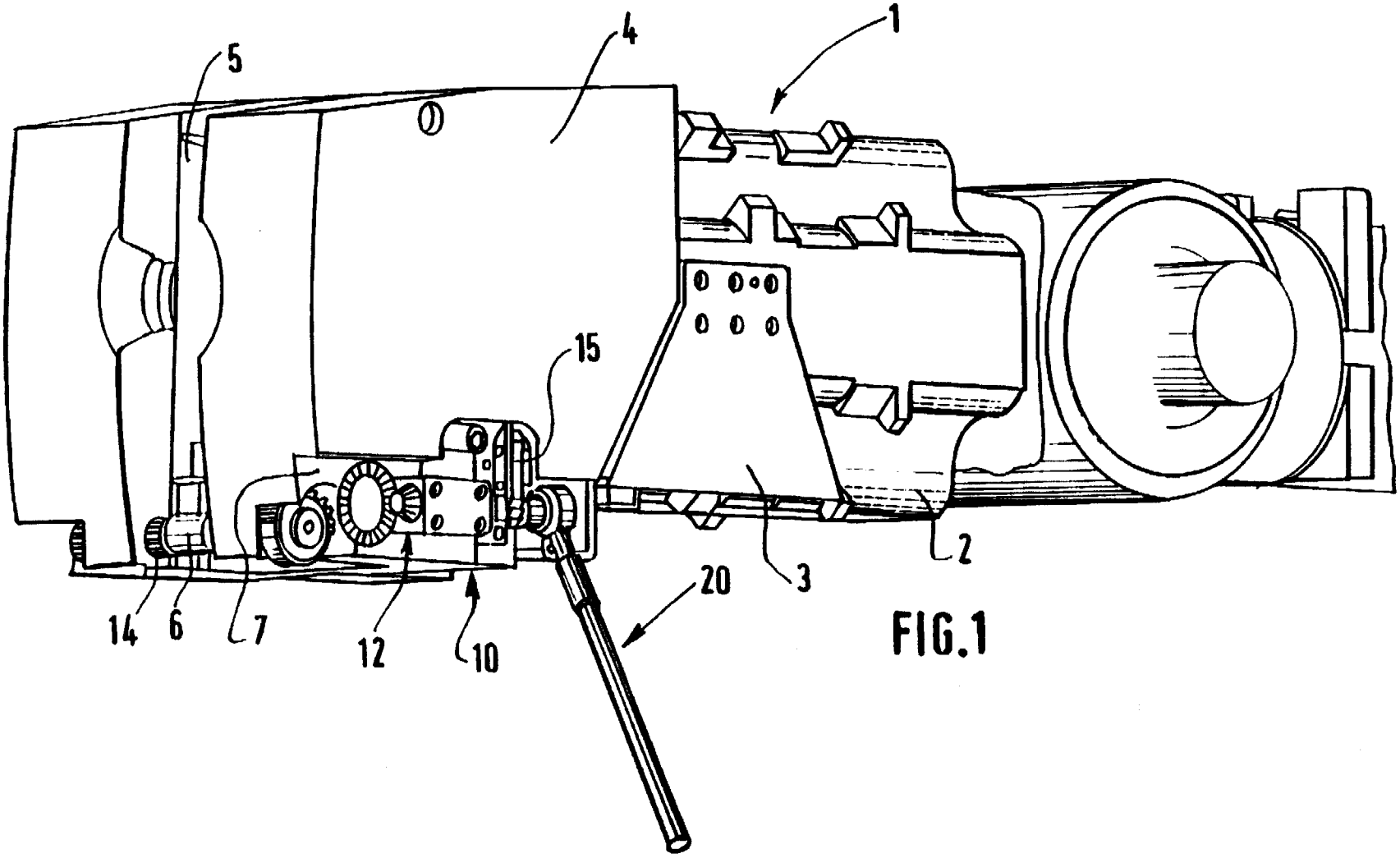
FIG. 1 is a perspective view of a gun according to the invention.

FIG. 1 shows a portion of a gun 1 having a known sleeve 4 and a movable wedge breechblock 5 disposed within the sleeve, as in the type of gun used in Leclerc 120 tanks. The sleeve 4 is attached in known fashion to a rear end of the gun 1 on a tube that slides in a cradle 2 and on a plate 3 that is integral with the cradle 2.

The gun 1 includes a manual opening device 10 disposed within at least one recess provided for that purpose. As a result, the manual opening device 10 does not increase the size of the gun 1. By operating the manual opening device 10, the wedge breechblock 5 can be opened.

The opening device 10 actuates a lever 6 to open the wedge breechblock 5 against an elastic return force exerted by, e.g., a spring that holds the wedge breechblock 5 closed. The force required to compress such a spring is on the order of 1000 daN.

Figures 2, 3:
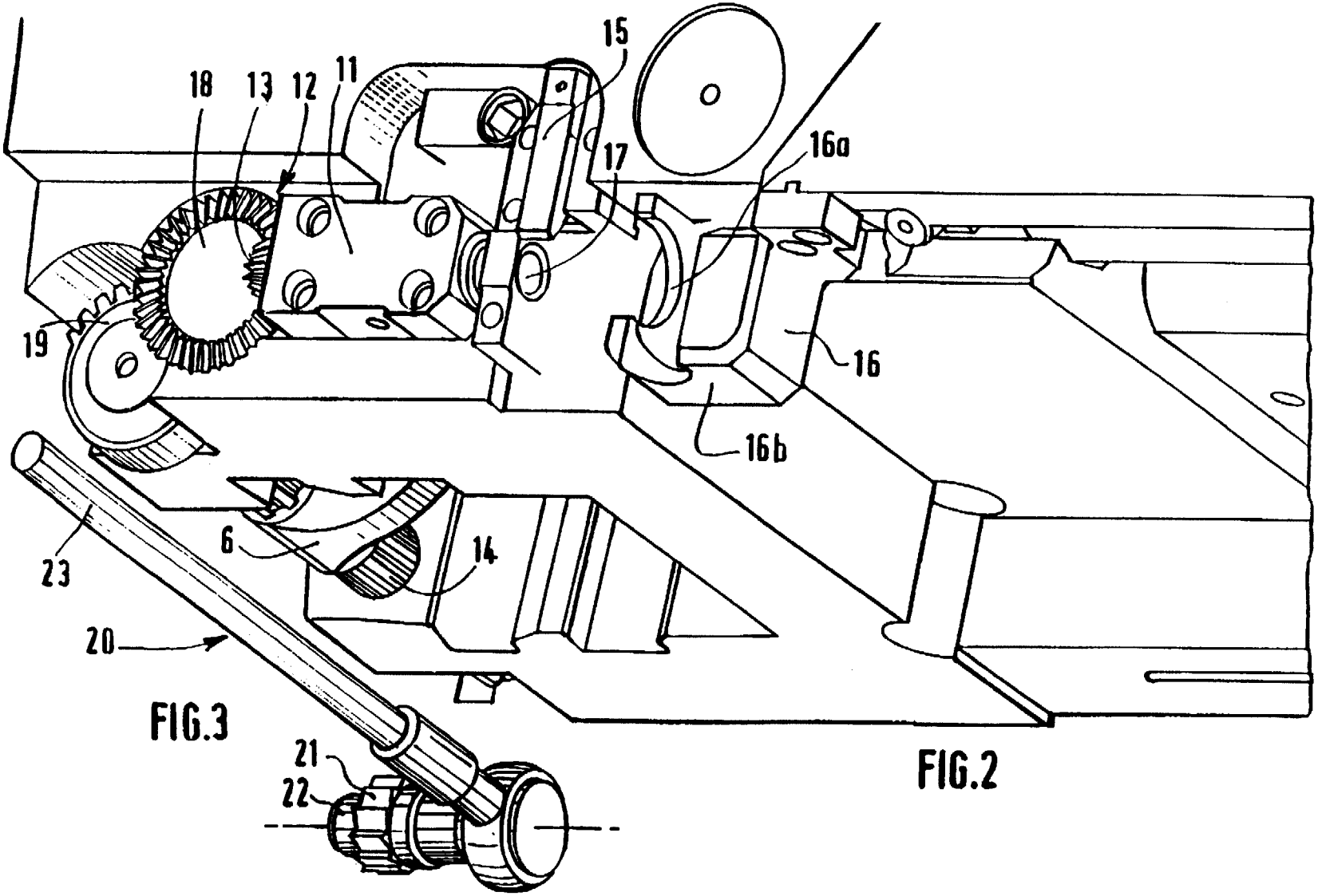
FIG. 2 is a perspective view of a manual opening device without a control device.
FIG. 3 is a perspective view of the control device.

As shown in FIG. 2, the opening device 10 includes a reducing gear train or drivetrain 12 having a splined rotating output shaft 14 and a rotating input shaft 17. The lever 6 that opens the wedge breechblock 5 is mounted to the output shaft 14. The input shaft 17 is guided to rotate inside a control box 11. A first end of the input shaft 17 includes a bevel gear 13 that engages a face gear 18 of the reducing gear train 12. The reducing gear train 12 includes a sector gear 19 that is mounted on the rotating output shaft 14 together with the lever 6. The gear train 12 reduces the force by a factor of approximately 60.

Figure 4:
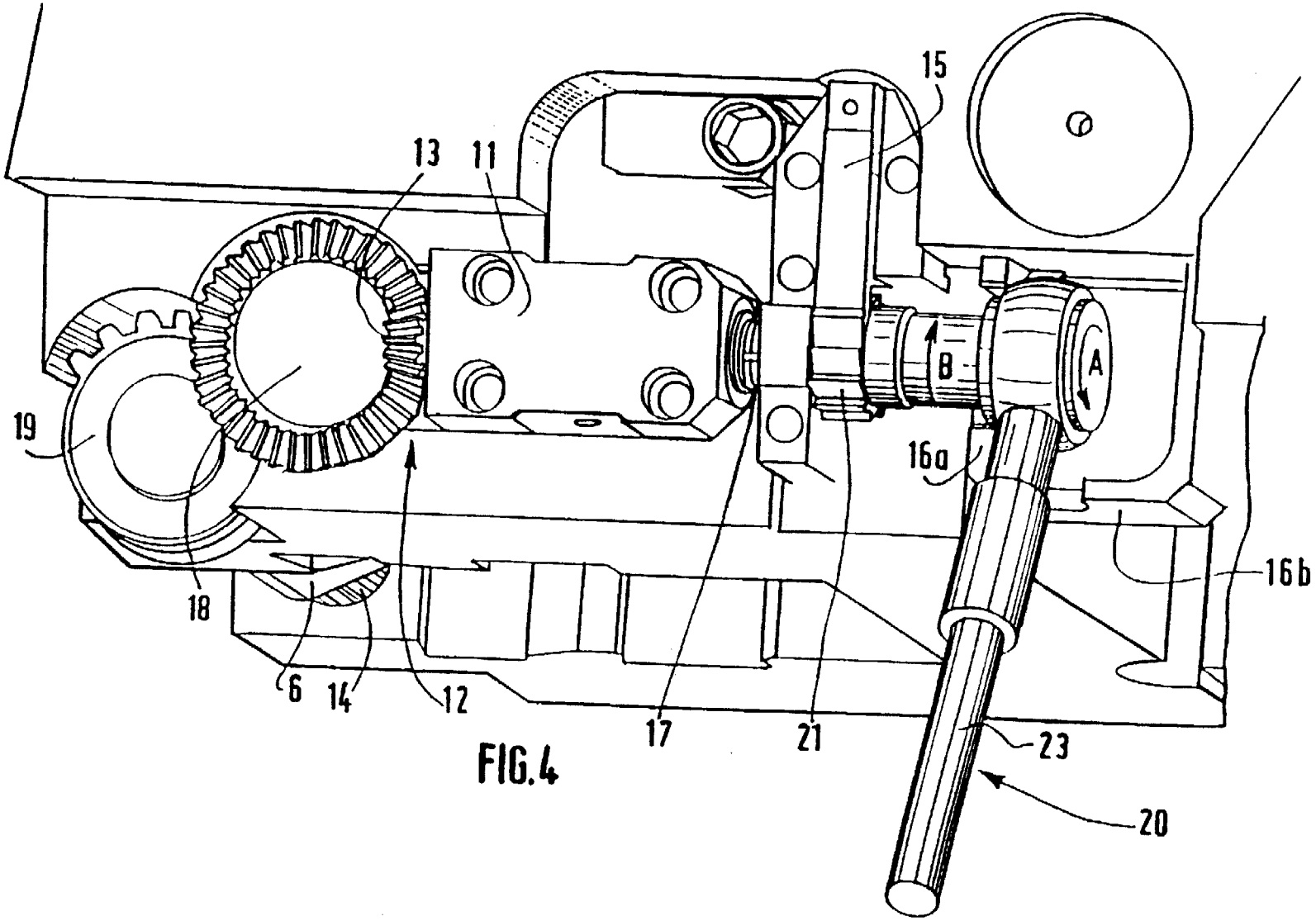
FIG. 4 is a perspective view of the manual opening device according to the invention.

As shown in FIG. 3, a second end of the input shaft 17 is designed to engage an engaging portion 22 of a manual control member 20. The engaging portion 22 can include a socket, e.g., of the hexagonal type, that engages the corresponding second end of the input shaft 17. As shown in FIG. 4, the control device 20 is connected to the input shaft 17 and rotated in a first rotational direction (as shown by arrow A) to cause the wedge breechblock 5 to open.

The manual control device 20 includes a handle 23 that extends substantially perpendicular to the engaging portion 22. The handle 23 allows the engaging portion 22 to be rotated and thus drive the gear train 12 in the direction of arrow A. The handle 23 is sufficiently long to generate a torque capable of actuating the manual opening device 10. The manual opening device 10 includes a blocking device 15 designed to block the gear train 12 from rotating in a second rotational direction (as shown by arrow B) opposite the first rotational direction A. As a result, the blocking device 15 allows the gear train to withstand the return force of the closing spring of the wedge breechblock 5.

In an illustrated example, the blocking device 15 is designed to prevent the manual control member 20 from rotating in the second rotational direction B. For this purpose, the control device 20 includes a ratchet 21 having a spring (not shown) that urges the ratchet to engage a toothed wheel. The ratchet 21 is mounted on the engaging portion 22 of the control device 20. When the ratchet 21 is connected to the input shaft 17, the teeth of the ratchet 21 engage the blocking device 15, which can be a pawl.

The manual control member 20 is removably connected to the input shaft 17 of the gear train 12. Because the manual control device is used in emergencies, it need not be permanently connected to the gun, but it can be stored in an on-board kit that travels with the gun. This reduces the size of the manual opening device 10 of wedge breechblock 5 but provides the desired safety function.

The gun includes a holder 16 that is designed to keep the manual control member 20 attached to the gun if the sleeve 4 recoils suddenly due to the explosion of a munition. As a result, the holder 16 prevents members of the artillery squad from being injured by the manual control member 20 during firing.

The holder 16 includes a first wall **16*a* having a recess designed to accommodate at least part of the engaging portion 22 of the control device 20, and a second wall 16*b* disposed substantially perpendicular to the first wall 16*a* that has a recess designed to accommodate at least part of the handle 23. The recesses have semicircular shapes to match the external shapes of the engaging portion 22 and the handle 23 of the control device 20, respectively. When the manual control device 20 is actuated, the munition may explode unintentionally, so the sleeve will recoil relative to the cradle. In such a case, the holder 16 holds the manual control device 20 on the gun and protects the user's arm from a sudden force, even if the manual control device 20 becomes detached from the end of the input shaft 17**.

In an alternative embodiment, the blocking device or pawl 15 can directly engage the bevel gear 13 of the gear train 12 and can include a device that keeps the pawl 15 disengaged when the manual control device 20 is not being used.

Although this invention is described in conjunction with specific embodiments thereof, many alternatives, modifications and variations will be apparent to those skilled in the art. Accordingly, the preferred embodiments of the invention as set forth above are intended to be illustrative, not limiting. Various changes to the invention may be made without departing from its true spirit and scope as defined in the following claims.

What is claimed is:

1. A manual breechblock opening device that actuates a breechblock lever to open a wedge breechblock of a gun against an elastic return force, said breechblock opening device comprising:

a manual control member;

a drivetrain having a rotating output shaft coupled to said breechblock lever and a rotating input shaft coupled to said output shaft and coupleable to said manual control member, wherein actuating said manual control member rotates said drivetrain in a first rotational direction and causes said output shaft to engage said breechblock lever and to open said wedge breechblock; and a blocking member coupled to said drivetrain and disposed to allow said drivetrain to rotate in said first rotational direction and to prevent said drivetrain from rotating in a second rotational direction opposite said first rotational direction.

2. The manual breechblock opening device of claim 1, wherein said manual control member is removably coupled to said input shaft.

3. The manual breechblock opening device of claim 1, wherein said blocking member engages said manual control member.

4. The manual breechblock opening device of claim 1, wherein said manual control member includes a ratchet and said blocking member includes a pawl disposed to cooperate with said ratchet.

5. The manual breechblock opening device of claim 1, wherein said blocking member is connectable to said gun.

6. The manual breechblock opening device of claim 1, wherein said manual control member includes an engaging portion shaped to engage said input shaft and a handle extending substantially perpendicular to said engaging portion.

7. The manual breechblock opening device of claim 1, further comprising a holder attached to said gun, said holder being disposed to hold said manual control member during recoil of said gun.

8. The manual breechblock opening device of claim 1, wherein said input shaft is disposed substantially perpendicular to said output shaft.

9. The manual breechblock opening device of claim 1, wherein said drivetrain reduces a manual control member force required to actuate said breechblock lever by a factor of approximately 60.

10. A gun having a wedge breechblock with a manual breechblock opening device that actuates a breechblock lever to open said wedge breechblock against an elastic return force, said breechblock opening device comprising:

a manual control member;

a drivetrain having a rotating output shaft coupled to said breechblock lever and a rotating input shaft coupled to said output shaft and coupleable to said manual control member, wherein actuating said manual control member rotates said drivetrain in a first rotational direction and causes said output shaft to engage said breechblock lever and to open said wedge breechblock; and a blocking member coupled to said drivetrain and disposed to allow said drivetrain to rotate in said first rotational direction and to prevent said drivetrain from rotating in a second rotational direction opposite said first rotational direction.

11. The gun of claim 10, wherein said manual control member is removably coupled to said input shaft.

12. The gun of claim 10, wherein said blocking member engages said manual control member.

13. The gun of claim 10, wherein said manual control member includes a ratchet and said blocking member includes a pawl disposed to cooperate with said ratchet.

14. The gun of claim 10, wherein said blocking device is connected to said gun.

15. The gun of claim 10, wherein said manual control member includes an engaging portion shaped to engage said input shaft and a handle extending substantially perpendicular to said engaging portion.

16. The gun of claim 10, wherein said drivetrain reduces a manual control member force required to actuate said breechblock lever by a factor of approximately 60.

17. The gun of claim 10, further comprising a holder attached to said gun, said holder being disposed to hold said manual control member during recoil of said gun.

18. The gun of claim 10, further comprising a recessed portion within which said manual breechblock opening device is disposed.

19. A manual breechblock opening device that actuates a breechblock lever to open a wedge breechblock of a gun against an elastic return force, said breechblock opening device comprising:

a selectively removable manual control member;

a drivetrain having a rotating output shaft coupled to said breechblock lever and a rotating input shaft coupled to said output shaft and coupleable to said manual control member, wherein actuating said manual control member rotates said drivetrain in a first rotational direction and causes said output shaft to engage said breechblock lever and to open said wedge breechblock; and a blocking member coupled to said drivetrain and disposed to allow said drivetrain to rotate in said first rotational direction and to prevent said drivetrain from rotating in a second rotational direction opposite said first rotational direction.

* * * * *